United States Patent [19]

Honda

[11] Patent Number: 4,607,941

[45] Date of Patent: Aug. 26, 1986

[54] PROCESS UNIT AND IMAGE FORMING APPARATUS USING SUCH UNIT

[75] Inventor: Haruhisa Honda, Yokohama, Japan

[73] Assignee: Canon Kabushiki Kaisha, Tokyo, Japan

[21] Appl. No.: 487,884

[22] Filed: Apr. 22, 1983

[30] Foreign Application Priority Data

Apr. 30, 1982 [JP] Japan ..... 57-074153

[51] Int. Cl.[4] ..... G03G 15/00

[52] U.S. Cl. ..... 355/3 R; 355/3 DR; 355/3 CH; 355/14 E

[58] Field of Search ..... 355/1, 3 R, 3 CH, 3 DR, 355/14 CH, 14 E, 67, 71

[56] References Cited

U.S. PATENT DOCUMENTS

| | | | |
|---|---|---|---|
| 3,811,048 | 5/1974 | Matsumoto et al. | 250/326 |
| 3,985,436 | 10/1976 | Tanaka et al. | 355/3 DD X |
| 4,080,057 | 3/1978 | Nakane et al. | 355/3 R X |
| 4,252,431 | 2/1981 | Cormier | 355/3 CH |
| 4,305,651 | 12/1981 | Umezawa et al. | 355/3 CH |
| 4,320,957 | 3/1982 | Brown et al. | 355/3 CH |
| 4,326,794 | 4/1982 | Nishimura | 355/3 R |
| 4,386,838 | 7/1983 | Hirabayashi et al. | 355/3 DR |
| 4,500,195 | 2/1985 | Hosono | 355/3 R |

FOREIGN PATENT DOCUMENTS

| | | | |
|---|---|---|---|
| 0049839 | 4/1977 | Japan | 355/3 CH |

*Primary Examiner*—Arthur T. Gimley
*Assistant Examiner*—J. Pendegrass
*Attorney, Agent, or Firm*—Fitzpatrick, Cella, Harper & Scinto

[57] ABSTRACT

The present invention solves the problem arising when a photosensitive medium and some or all of means for forming a latent image on the photosensitive medium are made into a unit which is removably mountable with respect to the body of an apparatus. This problem is attributable to the fact that the characteristic of the photosensitive medium is not constant, and lies in that the completed electrostatic latent image differs from one photosensitive medium to another. The present invention solves this problem by providing an adjusting function to the means of such unit itself used to form a latent image.

12 Claims, 9 Drawing Figures

PROCESS UNIT AND IMAGE FORMING APPARATUS USING SUCH UNIT

BACKGROUND OF THE INVENTION

1. Field of the Invention

This invention relates to an image forming apparatus such as an electrophotographic copying apparatus or an image recording apparatus, and particularly to an image forming apparatus which requires interchange of image forming means, replenishment of consumption agents, discarding of waste materials, etc.

2. Description of the Prior Art

Description will hereinafter be made with an electrophotographic copying apparatus taken as an example.

In an image bearing member (hereinafter referred to as the photosensitive medium) applied to the electrophotographic copying apparatus of this type, photosemiconductors such as Se, CdS, organic semiconductors and the like are used as the raw materials, and irregularity in the components of these raw materials and irregularity in the manufacturing conditions such as the synthesis proportion and working temperature of the raw materials may also lead to irregularity in the physical performance and characteristic of the completed photosensitive medium. Therefore, if use is made of latent image forming means which are identical in latent image formation conditions such as the exposure amount of the original image and the voltage applied to the corona discharger, irregularity will usually occur in the latent image formed on the photosensitive medium in accordance with the performance and characteristic of the photosensitive medium. As a result, depending on the photosensitive medium, the developed image thereon may become thin or fog may be created in the background portion of the image. For this reason, it has heretofore been the usual practice that the charging condition, the exposure condition, etc. are set in conformity with the performance and characteristic of the photosensitive medium during the manufacture of the electrophotographic copying apparatus and after the apparatus has been used in the market, each time the photosensitive medium is interchanged, a serviceman sets the charging condition, the exposure condition, etc. in accordance with the performance and characteristic of the interchanged photosensitive medium in the same manner as during the manufacture. However, these operations not only require much labor but also require the serviceman to visit the user to adjust these conditions each time the photosensitive medium is interchanged, and this results in higher service cost and consequently higher copying cost on the part of the user. Also, the adjustment by the serviceman is carried out subjectively while he is watching the image and therefore, the difference in adjustment result attributable to the experience of the serviceman himself is great. Further, in the market, the various physical properties (surface potential, etc.) of the interchanged photosensitive medium are not measured, and this has led to the disadvantage that the adjustment is liable to be unreliable.

SUMMARY OF THE INVENTION

The present invention is proposed in view of the above-noted situation and an object thereof is to provide a process unit which eliminates the necessity of adjusting the latent image formation conditions in accordance with the photosensitive medium when interchanged and which enables more reliable setting of the latent image formation conditions to be accomplished, and to provide an image forming apparatus using such process unit.

To achieve such object, according to the present invention, a photosensitive medium and means used to form an electrostatic latent image on the photosensitive medium are made into a unit independent of the apparatus body and an adjusting function is added to the means used to form a latent image. Due to the presence of such adjusting function, it becomes possible to provide said unit with the latent image formation conditions conformable to the inserted photosensitive medium when the unit is manufactured. As a result, the light source and high output voltage on the apparatus body side which are associated with the latent image forming means can be set constant and when the photosensitive medium is to be interchanged, the unit may be simply interchanged to thereby ensure formation of images of high quality.

The invention will become more fully apparent from the following detailed description thereof taken in conjunction with the accompanying drawings.

DESCRIPTION OF THE PREFERRED EMBODIMENT

An electrophotographic copying apparatus as an embodiment of the image forming apparatus of the present invention will hereinafter be described with reference to the drawings.

Figure 1:
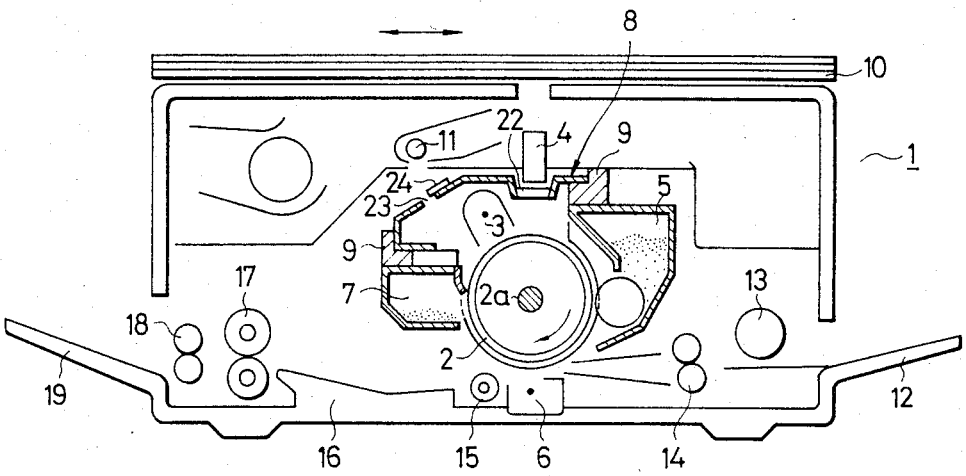
FIG. 1 is a cross-sectional view of the essential portions of an image forming apparatus to which the present invention is applied.
Figure 3:
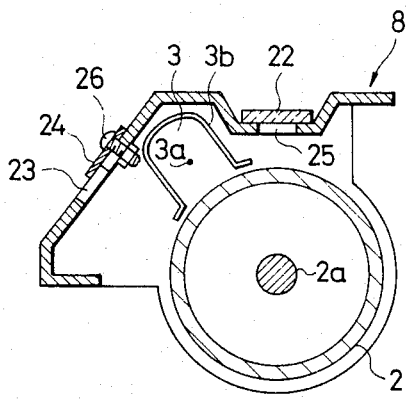
FIG. 3 is a cross-sectional view of the photosensitive medium unit.

FIG. 1 is a cross-sectional view showing the essential portions of an electrophotographic copying apparatus to which an embodiment of the present invention is applied. In the apparatus 1 which is a copying apparatus using the electrophotographic process, a photosensitive medium 2 comprising a photoconductive layer provided on a conductive drum base is supported on a shaft 2*a* so that it is rotatable in the arrow direction by the drive force from the apparatus body. Disposed around and in accordance with the direction of rotation of the photosensitive medium 2 are a corona discharger 3, a short-focus optical element array 4, a developing device 5 using nonmagnetic toner and conveying and supplying the toner to the photosensitive medium 2 by a magnetic field, a transfer corona discharger 6 and a cleaning device 7 which are means used during latent image formation. In the apparatus 1 illustrated, the photosensitive drum 2 and the corona discharger 3 are integrally supported in a housing 8, and as shown in FIG. 3, an image exposure amount adjusting filter 22 is mounted in an image exposure slit 25 formed in the housing 8 and a pre-exposure amount adjusting plate 24 is mounted in a pre-exposure window 23, thereby constituting a photosensitive medium unit. The housing 8 is guided and supported by rails 9 secured to the apparatus body and may be mounted or dismounted with respect to the apparatus body by being inserted or withdrawn in the arrow direction indicated in FIG. 2.

In the copying apparatus 1 of the above-described construction, the surface of the photosensitive medium 2 is uniformly charged with a predetermined polarity by the corona discharger 3, and then an original resting on a reciprocally movable original carriage 10 on top of the apparatus body is illuminated by a lamp 11 and the reflected light from the original is projected onto the photosensitive medium 2 through the element array 4, whereby a latent image corresponding to the image of the original is formed on the surface of the photosensitive medium. The latent image thus formed is developed by the charged toner in the developing device 5. On the other hand, a transfer medium is manually supplied to a transfer medium supply tray 12 and conveyed to a transfer station by means of a conveyor roller 13 and timing rollers 14, whereupon the developed image on the photosensitive drum 2 is transferred onto the transfer medium by the transfer corona discharger 6. After the image transfer, the transfer medium is separated from the photosensitive drum 2 by separating means 15 and transported through a movement path 16 to a fixing device 17, where the transferred image is fixed, and then the transfer paper is discharged through discharge rollers 18 onto a paper discharge tray 19. After the image transfer, the photosensitive medium 2 is cleaned by the cleaning device 7 for removal of any residual toner and the memory of the previous copying cycle on the photosensitive medium is erased by the pre-exposure effected with part of the light from the lamp 11 directed to the photosensitive medium and thus, the photosensitive medium becomes ready for another copying cycle.

Figure 2:
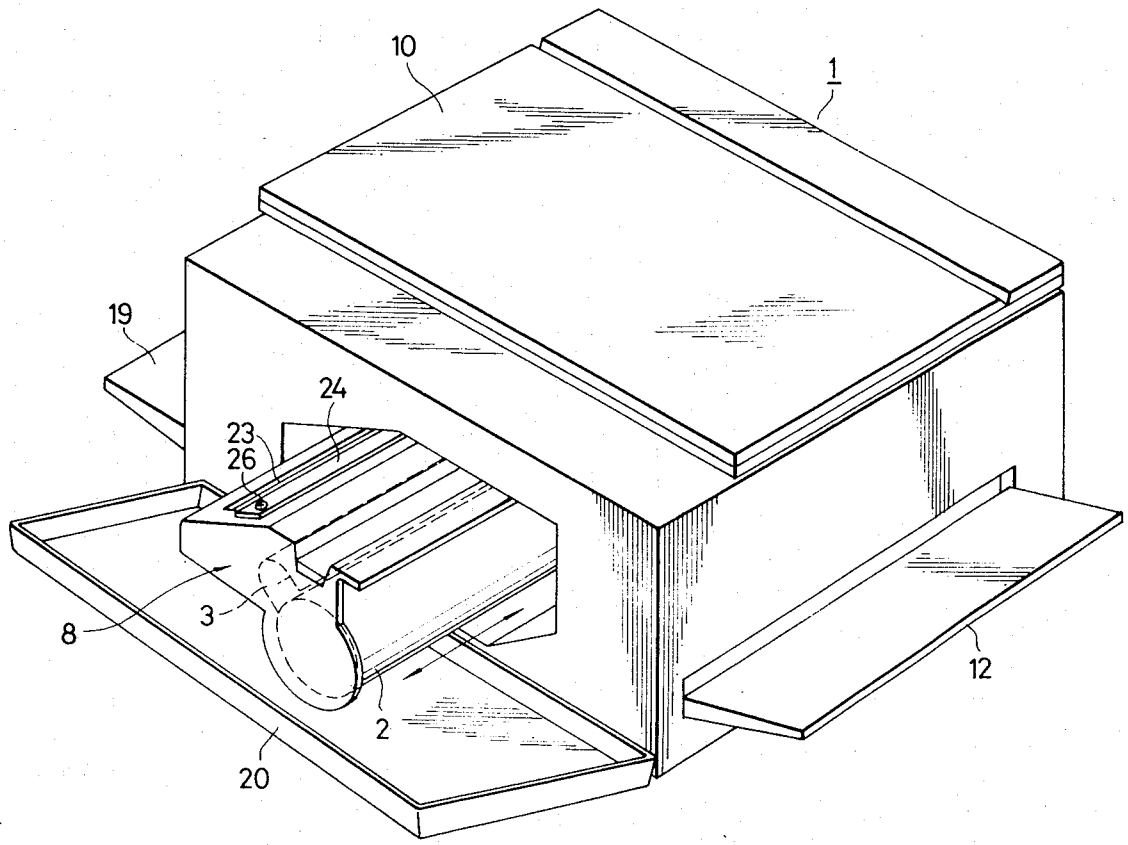
FIG. 2 is a perspective view showing a photosensitive medium unit as mounted or dismounted with respect to the body of the apparatus of FIG. 1.

FIG. 2 is a perspective view showing the mounting-dismounting of the photosensitive medium unit with respect of the apparatus body. The photosensitive medium unit may be mounted or dismounted by opening the front door 20 of the apparatus body and manually moving the photosensitive medium unit in the arrow direction indicated in FIG. 2.

FIG. 3 shows a cross-sectional view of the photosensitive medium unit, each portion of which may be changed in condition. For example, as regards the exposure before the charging, by moving a quantity-of-light adjusting plate 24 which is a means used for latent image formation to thereby change the area of the opening of an exposure window 23, the exposure amount from the lamp 11 imparted to the photosensitive medium before the charging can be adjusted to an optimum quantity of light fit for the characteristic of the photosensitive medium. Designated by 26 is a set screw for fixing the quantity-of-light adjusting plate 24 at its adjusted position. The distance between the charging wire of the discharger 3 and the photosensitive medium is variable and such distance may be set in accordance with the characteristic of the photosensitive medium to thereby always provide an optimum charging condition. Further, where the sensitivity of the photosensitive medium differs, the number of image exposure adjusting filters 22 to be mounted is determined in conformity with the different sensitivity to thereby always provide a proper quantity of light.

A specific example of the adjustment of the latent image formation conditions provided on the photosensitive medium unit and an embodiment therefor will be described in greater detail.

Figure 4:
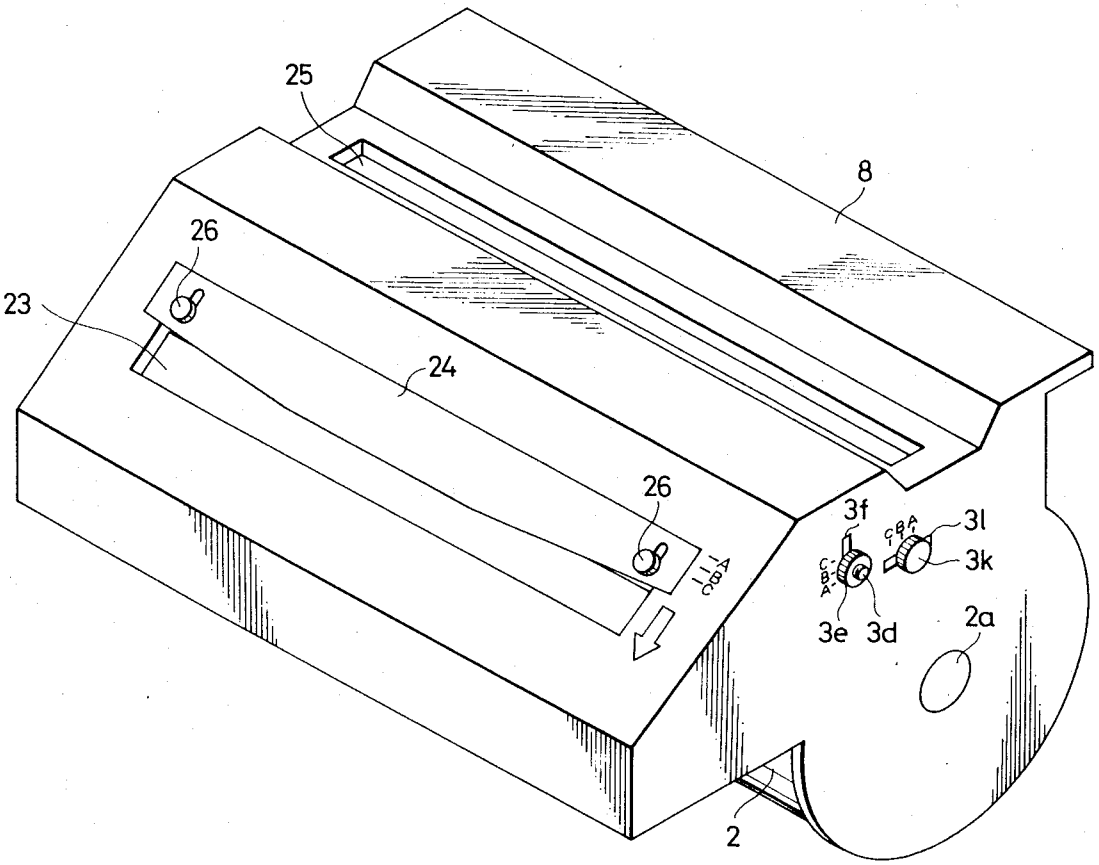
FIG. 4 is a perspective view showing an embodiment of the photosensitive medium unit.

Referring to FIG. 4, the central portion of the adjusting plate 24 is of a convex shape to prevent the quantity of light in the central portion of the slit from becoming excessive due to the characteristic of the lamp or the like. In this embodiment, there are three ranks A, B and C in accordance with the characteristic of the photosensitive medium and the housing 8 has index marks A, B and C thereon correspondingly to the mounted position of the adjusting plate 24. Accordingly, when the characteristic of the photosensitive medium is judged as "B", it is possible to obtain a latent image formation condition conformable to the inserted photosensitive medium simply by registering the position of the adjusting plate 24 relative to the housing with the index mark "B" on the housing 8 on the basis of the judgment during the manufacture of the photosensitive medium unit.

Description will now be made of an example of the case where the amount of corona discharge to the photosensitive medium is adjusted. In such case, the distance between the corona wire **3*a* (FIG. 3) and the surface of the photosensitive drum may be varied or the distance between the open side of the shield plate 3*b* (FIG. 3**) and the side thereof adjacent to the photosensitive drum may be varied.

Figure 5:
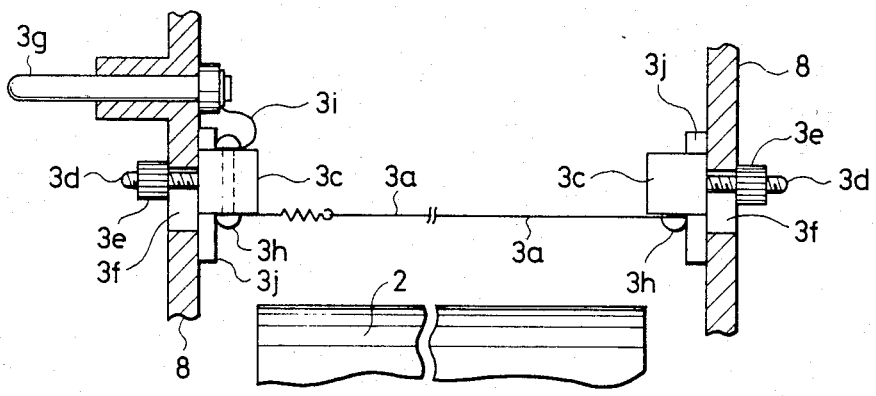
FIG. 5 is a cross-sectional view showing a mechanism for adjusting the distance between a corona wire and the surface of the photosensitive medium.

Specifically, as the means for changing the position of the corona wire **3*a*, a nut 3*e* is fitted on a bolt 3*d* integral with an insulating block 3*c* supporting the end portion of the corona wire, as shown in the fragmentary cross-sectional view of FIG. 5. By loosening this nut 3*e*, the block 3*c* is rendered movable along a slot 3*f*. The reference numeral 3*g* at the left end of FIG. 5 designates a unit side connector coupled to a high voltage output connector (not shown) on the body side when the unit is inserted into a predetermined position in the body. The connector 3*g* and the wire 3*a* are electrically connected together by a conductive bolt 3*h* and a flexible cord 3*i*. With the above-described construction, the distance between the photosensitive medium and the wire 3*a* can be adjusted as desired, by the position of the nut 3*e* relative to the slot 3*f*. In FIG. 5, a convex guide 3*j* for preventing rotation of the block 3*c*** is provided along the slot.

Figure 6:
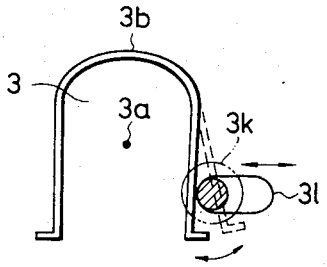
FIG. 6 is a cross-sectional view showing a mechanism for adjusting the width of the opening of the shield plate of a discharger.

A case where the width of the opening of the shield plate is adjusted will now be shown exemplarily. Referring to FIG. 6 which is a fragmentary cross-sectional view, that side of the screw **3*k* of the shield plate 3*b* which is adjacent to the housing bears against the outer side of the shield plate 3*b*. The width of the opening of the shield plate 3*b* is set by fixing the position of the screw 3*k* within the range of a slot 3*l* against the resiliency of the shield plate 3*b*** itself.

Again in the embodiment described in connection with FIGS. 5 and 6, index marks A, B and C corresponding to A, B and C so named in accordance with the characteristic of the photosensitive medium are provided near the slot in which the screws 3e and 3k are moved, whereby it becomes possible to set the latent image formation condition conformable to the photosensitive medium quickly and with predetermined accuracy, as in the case of the adjusting plate 24 of FIG. 4.

Figure 7:
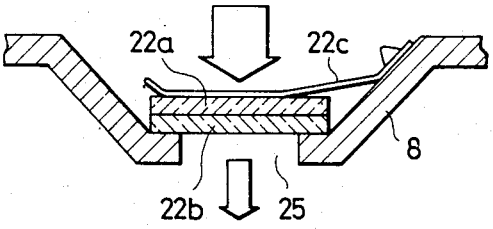
FIG. 7 is a cross-sectional view showing a mechanism for adjusting the quantity of light transmitted through a slit exposure portion.

An example of the adjustment of the exposure amount of the original image will now be described with reference to FIG. 7 which is a fragmentary cross-sectional view of the exposure portion. In FIG. 7, reference numerals 22a and 22b designate two ND filters disposed in a slit opening 25 and having the same transmission factor. That is, during the manufacture of the photosensitive medium unit, the ND filters are made into such a type that the quantity of light is least at this opening (in the illustrated embodiment, two ND filters are mounted), and one or both of these filters 22a and 22b are removed in accordance with the characteristic of the inserted photosensitive medium as required, thereby adjusting the quantity of light passing through this slit opening 25.

Of course, use may be made of adjusting means of the type similar to the aforementioned adjusting plate 24 for pre-exposure or, conversely, the filters as shown in FIG. 7 may be removed from the preexposure portion and instead, use may be made of adjusting means of the type which adjusts the quantity of light.

Now, it is because the characteristic differs from one photosensitive medium to another as described above that it is necessary to adjust the slit opening forming a part of the optical system of the latent image forming means as described above and the operating conditions of the corona discharger. As regards a photosensitive medium unit using such a photosensitive medium, the charging characteristics (charging potential, attenuation factor of potential, etc.) of the photosensitive medium are measured as by a potentiometer, for example, for each manufacturing lot, during the production of the photosensitive medium, said latent image formation condition is set at an optimum value in accordance with the characteristics of the photosensitive medium, and said latent image formation condition is set at its set value when the photosensitive medium 2 is incorporated into the photosensitive medium unit. Also, the apparatus body in which such photosensitive medium unit is mounted is so made that each input from an operative component on the body entering the latent image forming means such as the corona and the quantity of light of the lamp are always constant in any apparatus. For example, the apparatus is so made that the voltage applied to the discharger 3 is constant in any apparatus and the illumination in front of the image exposure amount adjusting filter is also constant in any apparatus and therefore, adjustment or the like of the body is unnecessary and at the same time, the adjustment during the insertion of the unit is also unnecessary.

With such a construction, when it has become necessary to interchange the photosensitive medium at the end of its service life, even if the user obtains the photosensitive medium unit or arbitrarily takes out a photosensitive medium unit from his spare stock and interchanges the old unit with a new one, good image will be obtained without the necessity of adjusting the latent image formation conditions such as charging and exposure in accordance with the characteristic of the photosensitive medium. Accordingly, no serviceman will have to visit the user to interchange the photosensitive medium. Thus, the service cost will be reduced and this means a reduced copying cost to the user. Heretofore, adjustment has been carried out by a serviceman on a trial and error basis and with his sixth sense while watching the image, but according to the present invention, all of the optimum latent image formation conditions can be set at the production site.

In the above-described embodiment, the preexposure amount adjusting plate 24, the discharger 3 and the image exposure amount adjusting filter 22 have been mentioned as the latent image forming means, but only one or two of them may be employed, as required.

Figure 8:
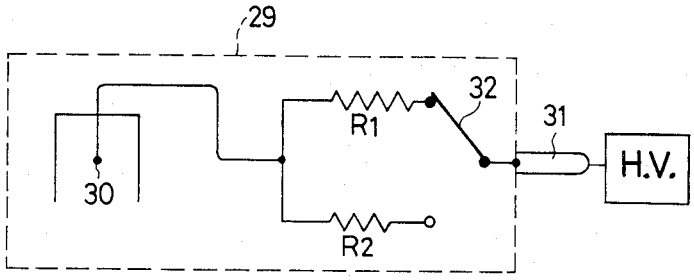
FIG. 8 illustrates another embodiment for adjusting the amount of corona discharge.

Further, for the adjustment of the charge amount to the photosensitive medium, as illustrated in FIG. 8, resistors $R_1$ and $R_2$ having a plurality of types of load resistance values may be disposed parallel between a corona wire 30 within a unit 29 and a unit side connector 31 coupled to a power supply connector (not shown) on the apparatus body side, the resistor to be used may be selected by a switch 32 in accordance with the characteristic of the photosensitive medium and the latent image formation condition may be set thereby. Further, where the discharger has a grid, a plurality of varistors having different ratings may be disposed parallel to the grid, as shown in FIG. 8, and may likewise be selected for use by a switch.

Figure 9:
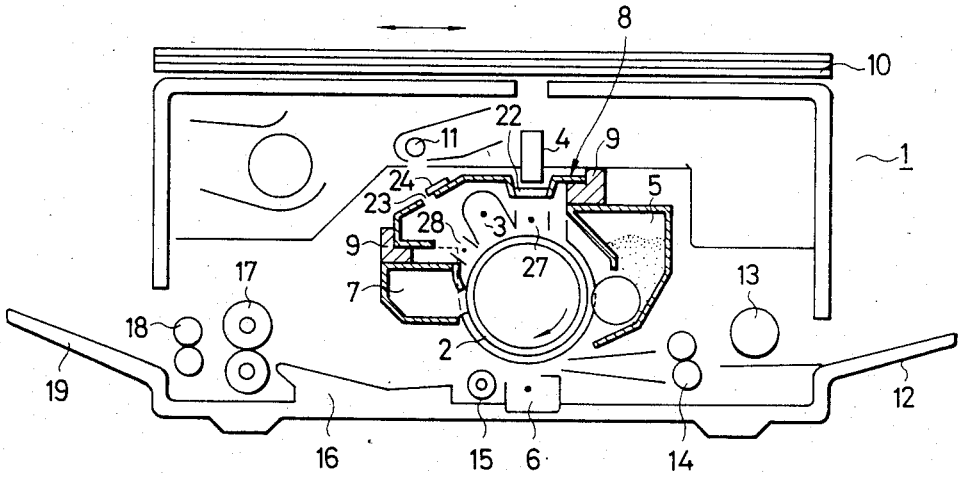
FIG. 9 is a cross-sectional view of the essential portions of another copying apparatus to which the present invention is applicable.

The latent image forming means are not limited to those mentioned in the embodiment of FIG. 1, but may include a discharger 28 provided in front of the discharger 3, a discharger 27 operated simultaneously with the image exposure, and auxiliary exposure means, as shown in FIG. 9. Further, the photosensitive medium unit may include therein, for example, a cleaning device and a developing device as other image forming means. Also, in the above-described embodiment, a drum having a photosensitive layer applied thereto has been shown as the photosensitive medium, whereas the photosensitive medium may also be in the form of a belt or a sheet-like photosensitive medium wrapped around a support member.

Description will now be made of some examples of the adjustment of the characteristic of the photosensitive medium by the latent image forming means. As an example of the characteristic of the photosensitive medium, it is assumed that the dark area potential and the light area potential are $V_D$ and $V_L$, respectively, and that the potentials optimum to the development and other conditions are $V_D = +600 \pm 30$ V and $V_L = +100 \pm 30$ V. These are determined by the degree of allowance for fog, image density and image quality. Describing a first example of the adjustment in which $V_L$ is adjusted to a desired value by the embodiment of FIG. 7, the surface potentials of photosensitive mediums are measured in advance, and as to each photosensitive medium or each lot, the photosensitive medium in which $V_L = 100 \pm 30$ V is classified as ⓐ, the photosensitive medium in which $V_L = 160 \pm 30$ V is classified as ⓑ and the photosensitive medium in which $V_L = 220 \pm 30$ V is classified as ⓒ. This classification into three stages may be effected by measuring the potentials with the photosensitive mediums incorporated in the unit and with the filters 22a and 22b of FIG. 7 remaining attached thereto. On the other hand, the filters 22a and 22b are preset so as to have such a transmission factor that will create such a variation in image exposure amount that, from the characteristic of the photosensitive medium, $V_L$ is reduced by about 60 V if the filter 22a is removed and $V_L$ is reduced by about 120 V if both filters 22a and 22b are removed. Therefore, during the manufacture, in accordance with the aforementioned three stages ⓐ, ⓑ and ⓒ indicated on the photosensitive mediums or the photosensitive medium units, the worker carries out the work of leaving the filters 22*a* and 22*b* as they are in the case of ⓐ, removing only the filter 22*a* in the case of ⓑ or removing the filters 22*a* and 22*b* in the case of ⓒ and if required, measures the potential thereafter to thereby confirm that the potential is $V_L=100\pm30$ V. By such a method, $V_L$ can be reliably adjusted to a value within a desired range even if there is some irregularity in the characteristic of the photosensitive mediums.

An example in which $V_D$ is adjusted will now be shown with respect to the embodiment of FIG. 5. For each manufactured photosensitive medium or lot, a latent image is formed under such a discharging condition that the position of the corona wire is such that the center of the nut 3*e* lies at the center of the slot 3*f*, that is, the center of the nut lies at "B" in FIG. 4, and then the potential $V_D$ is measured. At that time, the photosensitive medium in which $V_D=600\pm30$ V is classified as Ⓑ, the photosensitive medium in which $V_D=540\pm30$ V is classified as Ⓐ, and the photosensitive medium in which $V_D=660\pm30$ V is classified as Ⓒ, and such classification into three stages is indicated on the photosensitive mediums. This classification into three stages may also be carried out by incorporating each photosensitive medium into the photosensitive medium unit set to the aforementioned discharging condition at first and then effecting the measurement. On the other hand, generally, as the discharging wire is nearer the photosensitive medium, the $V_D$ of the photosensitive medium rises and therefore, from the characteristic of the discharger, the divisions "A, B and C" provided near the slot 3*f* of FIG. 4 are marked on the outer wall of the photosensitive medium unit as shown in FIG. 4 in such a manner that "A" indicates the position of the nut 3*e* when it has come to such a position of the corona wire that $V_D$ rises by about 60 V as compared with the time when the center of the nut 3*e* lies at B and that "C" indicates the position of the nut 3*e* when it has come to such a position of the corona wire that $V_D$ is reduced by about 60 V. In accordance with the marks Ⓐ, Ⓑ and Ⓒ thus indicated, the worker moves the position of the nut 3*e* to "A, B and C", respectively. (In the case of Ⓑ, the nut is not moved.) Then, the worker measures the potential as required and thereby confirms that $V_D=600\pm30$ V. In this manner, $V_D$ can be reliably secured within a desired range even if there is some irregularity in the characteristic of the photosensitive mediums.

Where higher adjustment accuracy is required, four or more stages may be used instead of three stages.

The construction of the present invention in which the photosensitive medium and the latent image forming means are made integral with each other and mounted or dismounted with respect to the apparatus body results in the following effects:

(1) Reliable latent image formation conditions can be set for the irregularity of the characteristic of the photosensitive medium;

(2) When the photosensitive medium is to be interchanged, no serviceman need visit the user and even the user can interchange the photosensitive medium easily and quickly and adjustment thereof is not necessary;

(3) The subjective judgment and adjustment which have heretofore relied on the serviceman's experience and sixth sense during interchange of the photosensitive medium are eliminated and stable images can always be formed; and (4) The charger and the photosensitive medium are made integral with each other and interchanged at one time, whereby the unsatisfactory images resulting from the stains of the charging wire caused by long-term use thereof can be obviated.

What I claim is:

1. An interchangeable process unit removably mountable with respect to the body of an image forming apparatus including operative components, said process unit having:

an endlessly movable photosensitive medium;

means to form a latent image on said photosensitive medium;

a housing for integrally supporting said photosensitive medium and said means to form a latent image; and adjusting means provided on the exterior of said housing for adjusting the latent image formation conditions for said photosensitive medium without adjusting said operative components of said body.

2. A process unit according to claim 1, wherein said adjusting means on said process unit is a light adjusting member for controlling the quantity of light which reaches said photosensitive medium from a light source on the apparatus body.

3. A process unit according to claim 2, wherein said light adjusting member is a light-intercepting plate movably mounted to adjust the SRC of an opening for directing light onto said photosensitive medium of said unit.

4. A process unit according to claim 2, wherein said light adjusting member is a transmission factor adjusting member mounted in an exposure slit of said unit.

5. A process unit according to claim 1, wherein said adjusting means is a member for adjusting the amount of charging of said photosensitive medium resulting from corona discharge produced on the basis of a predetermined output from means on the apparatus body.

6. A process unit according to claim 5, wherein said adjusting member is a member for adjusting the distance between said photosensitive medium and a corona discharge electrode.

7. A process unit according to claim 5, wherein said adjusting member is a member adjusting the width of the shield opening of a corona discharger.

8. A process unit according to claim 1, wherein said adjusting means on said process unit is a light adjusting member for controlling the quantity of light which reaches said photosensitive medium from a light source on the apparatus body, and a member for adjusting the amount of charging of said photosensitive medium resulting from corona discharge produced on the basis of a predetermined output from means on the apparatus body.

9. An image forming apparatus comprising:

a machine body including operative components;

an interchangeable process unit detachably mounted to said machine body, said process unit having an endlessly movable photosensitive medium, first means to form a latent image on said photosensitive medium, a housing for integrally supporting said photosensitive medium and said first means, and adjusting means provided on the exterior of said housing for adjusting the latent image formation conditions for said photosensitive medium without adjusting said operative components of said machine body;

a guide member for guiding the movement of said unit when said unit is mounted to or dismounted from said machine body; and second means to form a latent image and having a predetermined output independent of the inserted process unit.

10. An image forming apparatus according to claim 9, wherein said second means is a lamp which emits a predetermined quantity of light and said adjusting means comprises a light adjusting member for controlling the quantity of light which reaches said photosensitive medium.

11. An image forming apparatus according to claim 9, wherein said second means is a high voltage source for a corona discharge and said adjusting means comprises a member for adjusting the amount of charge of said photosensitive medium.

12. An image forming apparatus according to claim 9, wherein said second means include a lamp which emits a predetermined quantity of light and a high voltage source for a corona discharge and said adjusting means include a first member for controlling the quantity of light which reaches said photosensitive medium and a second member for adjusting the amount of charge of said photosensitive medium.

* * * * *

UNITED STATES PATENT AND TRADEMARK OFFICE

CERTIFICATE OF CORRECTION

PATENT NO. : 4,607,941

DATED : August 26, 1986

INVENTOR(S) : HARUHISA HONDA

It is certified that error appears in the above-identified patent and that said Letters Patent is hereby corrected as shown below:

COLUMN 5

Line 24, "preexposure" should read --pre-exposure--.
Line 47, "corona" should read --corona charge--.

COLUMN 6

Line 6, "preexposure" should read --pre-exposure--.

COLUMN 8

Line 30, "SRC" should read --size--.
Line 46, "member" should read --member for--.

Signed and Sealed this

Tenth Day of March, 1987

*Attest:*

DONALD J. QUIGG

*Attesting Officer*

*Commissioner of Patents and Trademarks*